United States Patent [19]

Prat

[11] Patent Number: 5,046,535

[45] Date of Patent: Sep. 10, 1991

[54] AUTOMATIC REPAIR OF BROKEN WARP THREADS IN WEAVING MACHINES

[75] Inventor: Roberto E. Prat, Barcelona, Spain

[73] Assignee: Texipat, S. A., San Jose, Costa Rica

[21] Appl. No.: 417,312

[22] Filed: Oct. 5, 1989

[30] Foreign Application Priority Data

Oct. 10, 1988 [GB] United Kingdom ..... 8823734

[51] Int. Cl.[5] ..... D03D 51/20; D03D 51/28

[52] U.S. Cl. ..... 139/351; 139/351; 139/353; 139/368

[58] Field of Search ..... 139/351, 353, 35, 368, 139/358

[56] References Cited

U.S. PATENT DOCUMENTS

| | | | |
|---|---|---|---|
| 4,791,967 | 12/1988 | Vandeweghe et al. | 139/353 |
| 4,815,498 | 3/1989 | Gryson et al. | 139/351 |
| 4,905,737 | 3/1990 | Gryson et al. | 139/35 |
| 4,911,207 | 3/1990 | Gryson et al. . | |

FOREIGN PATENT DOCUMENTS

| | | | |
|---|---|---|---|
| 2028637 | 12/1970 | Fed. Rep. of Germany | 139/35 |
| 708306 | 7/1931 | France . | |
| 1467134 | 1/1967 | France . | |
| 2238786 | 10/1977 | France . | |
| 60-9952 | 1/1985 | Japan . | |
| 60-81355 | 5/1985 | Japan . | |

*Primary Examiner*—Andrew M. Falik

*Attorney, Agent, or Firm*—Young & Thompson

[57] ABSTRACT

An apparatus automatically repairing broken warp threads in weaving machines or looms. The apparatus comprises a computerized control system having a memory storing predetermined characteristics for drawing-in of a harness and reeding each one of a plurality of weaving machines. The control system receives information on a row of drop wires which has brought about a stoppage in one of the weaving machines. A detecting device is controlled by the control system, which detecting device determines a numerical position of the fallen drop wire in a row of drop wires which contains the fallen drop wire, and sends information of this position to the computerized control system. A moving reed space counting device also controlled by the control system moves along the reed of the weaving machine and stops directly opposite the reed space at the location of a broken end corresponding to the fallen drop wire, responsive to information received as to the position of the fallen drop wire by the control system.

20 Claims, 7 Drawing Sheets

AUTOMATIC REPAIR OF BROKEN WARP THREADS IN WEAVING MACHINES

DESCRIPTION

The present invention relates to an apparatus and method for automatically repairing broken warp threads in weaving machines or looms. Means are known for facilitating the repair operations in warp threads which break during the operation of a weaving machine or loom. None of these previous means is completely satisfactory for none of them completely and automatically solves the breakage in the warp threads in a loom.

This applies to the means described in French patents 1.467.134 (DE FIVES) and 2.238.786 (SULZER), as applies with that described in previous patents, U.S. Pat. No. 2,512,165 (MEIER), FRENCH patent no. 708.306 (CATTEAU) or U.S. Pat. No. 2,834,381 (GRANGIER), for they are only partly successful devices which do not permit automatic repairs; the same applies in Japanese patents no. 60.81355 and no. 60-9952.

It is an object of the present invention to provide an apparatus and method enabling more satisfactory repair of broken warp threads in weaving machines or looms.

According to one aspect of the present invention there is provided apparatus for automatically repairing broken warp threads in weaving machines or looms, which has various means of transport and repair and control devices or organs, said apparatus comprising the following three inter-related means of actuation:

a) A computerized control system fitted with memory organs in respect of the drawing-in of the harness and reeding characteristics of each one of the weaving machines as well as the characteristics of the selvages and the number of threads used in each case, as well as the characteristics of the warp threads used in the mentioned weaving machine; organs for receiving the information on the row of drop wires which has brought about the stop in the weaving machine; receiving organs for the datum given by the detecting device in relation to the numerical position of the fallen drop wire and organs for data processing and sending the transfer order for a moving reed space counting device to go along the mentioned reed and stop before the corresponding space;

b) A detecting device controlled by the above-mentioned control system suitable for determining the numerical position of the fallen drop wire in the row of drop wires which contains the mentioned drop wire, also including means for sending the information of this position of the fallen drop wire to the said computerized control system; and c) A moving reed space counting device for the machine controlled by the above-mentioned control system—and suitable for moving along the reed of the weaving machine until placing itself and stopping directly opposite the reed space where the broken end corresponding to the fallen drop wire was, as a consequence of the information which has been received about the exact position of the fallen drop wire by the said control system.

According to another aspect of the present invention there is provided apparatus for automatically repairing broken warp threads in weaving machines or looms, comprising a unit formed by the following means:

a) A computerized control system which has, at least, memory organs in respect of the harness drawing in and reeding characteristics of each one of the weaving machines as well as the characteristics of the selvages and the number of threads used in each case, as well as the characteristics of the warp threads used in each weaving machine; organs for receiving the information on the row of drop wires which has brought about the stop in the weaving machine as well as the information given by a device detecting the position of the fallen drop wire in relation to its row and organs for data processing and sending the transfer order for a moving reed space counting device to place itself opposite the reed space corresponding to the drop wire; data processing organs fitted for later sending orders to the different operation devices which will be mentioned and which constitute the repair apparatus as well as for sending orders and controlling the displacements of some support means and in the event of their transfer, including the position changes for the different devices and their integrated actuating means;

b) A moving detecting device designed to count weaving machine drop wires so as to exactly set the numerical position of the fallen drop wire in relation to the row where it is located;

c) An operating means for the fallen drop wire and for the adjacent drop wires, which are located in the vertical line of the mentioned fallen drop wire, once they have entered the corresponding row of drop wires, ordered by the control system;

d) A moving reed space counting device, designed to place itself directly opposite the reed space corresponding to the place occupied by the broken end;

e) A device for removing the broken end which is joined to the cloth;

f) A removing device designed to remove the broken end which is joined to the warp;

g) A device for selecting and feeding the auxiliary yarn so that it has the same characteristics as the broken end.

h) A means for determining the joining of the mentioned auxiliary yarn to the broken warp end.

i) A drawing-in device designed to draw the previously mentioned auxiliary yarn into the corresponding drop wire of the broken end, once the mentioned auxiliary yarn has been joined to the broken warp end;

j) A threading device which picks up the auxiliary yarn which has been drawn in by the above device and threads it in the heddle of the harness and in the corresponding reed space, leaving it in position so that some retaining and tensing means will retain it until it is joined to the cloth and the excess from the join is cut off;

k) A means for retaining and tensing the auxiliary yarn which has been drawn in the heddle of the harness and in the reed and has been positioned on the cloth for its binding into the cloth by means of weft courses, including means for cutting off the excess once the mentioned join has been carried out.

l) One or more support means designed to support and where applicable transfer, at least some of the devices stated in a) to k) above, with these support means being controlled by the control system and when they are movable, being fitted with propulsion means and positioning control for each device and for its different integrating organs, such that each one of these devices and actuating means will occupy the right position at all times so as to duly participate in the operations for repairing the broken end.

Thus the inventive apparatus can include data processing elements and mechanical, electronic and electric elements which are interconnected so as to be able to service either a single loom unit or weaving machine, or to be able to proceed to service different weaving machines present in a cloth manufacturing room. The present invention solves the more and more evident need for weaving machines and looms to be able to be repaired, with regard to warp breakages—without the aid of manpower or specialized personnel directly involved in this task. The fact of being able to proceed automatically and quickly with the repair of the thread breakage(s) not only reduces the labor costs but also allows the time each weaving machine is stopped to be reduced to the minimum, which results in greater productivity from this machine, independently of the lesser costs for personnel.

From what is said above it is clear that the automatic repair apparatus which is the object of this invention reduces the total production costs, on increasing, on the one hand, the productivity of each weaving machine due to very substantial decrease in the time the weaving machine is stopped, and on the other hand, also decreases the production cost on the cost being cancelled for specialized manpower in the direct repair work on the breakages in each one of the mentioned machines.

The main objective of this invention is that of equipping weaving machines and looms with apparatus which allows the repair, without the intervention of the operator, of warp thread breakages which give rise to stops, whatever the thread breakages may be and whether it occurs in one part or some other part on the warp width.

Another objective of the invention is that of decreasing the weaving machine stopping times by removing down time of the operator responsible for the repair work, since by the present invention the repair process can commence as soon as the weaving machine stops.

With the present invention, the characteristics (count, material, color, twist and similar characteristics) of the broken thread are determined, along with the loom elements in which the mentioned broken thread are located (reed space, harness and drop wire).

The ends of the broken thread are removed from among those of the rest of the warp and the broken warp end is joined with an auxiliary yarn specially chosen and selected to coincide with the characteristics of the broken end.

The selected yarn is made to pass through the different organs of the weaving machine or loom in which the broken end was originally located.

The present invention enables the determination of the retension in the front part of the weaving machine of the already threaded auxiliary yarn, as well as the putting into operation of the weaving machine, without releasing the yarn until it is inseparably joined to the cloth. Then the transfer from the repairing apparatus to a stand-by position or, where applicable, in the event of the same apparatus being used in different areas, to another weaving machine needing its services, takes place.

As a consequence of the gathering of information which is accumulated in the memory units of the repair apparatus an alarm signal can be given when excessive yarn breakages are computerized in a determined machine, and within it, on a determined thread or groups of threads, corresponding to specific drop wires, heddles, harnesses or part of the reed, all of which is duly reflected for its correct, immediate correction.

Preferably the apparatus includes some auxiliary means so that the loom affected by the stop is positioned in such a way that it allows the actuation of the above-mentioned repair devices. So as to facilitate the understanding of this patent, some diagrams are enclosed in which different organs, elements, devices and units of such means which allow acting on the loom which has stopped due to a broken warp end, with the aim of repairing the breakdown, are represented diagramatically.

The present invention is also a method of automatically repairing broken warpthreads in weaving machines or looms, utilising the above apparatus of the present invention.

In the following example it will be understood that it is possible to replace elements and organs as described in the given example with other equivalent ones, as well as to break down or integrate one or several devices as described with the aim of obtaining functional results identical and/or similar to those obtained with the following example.

An embodiment of the present invention will now be described by way of example with reference to the accompanying drawings wherein.

Figure 8D:
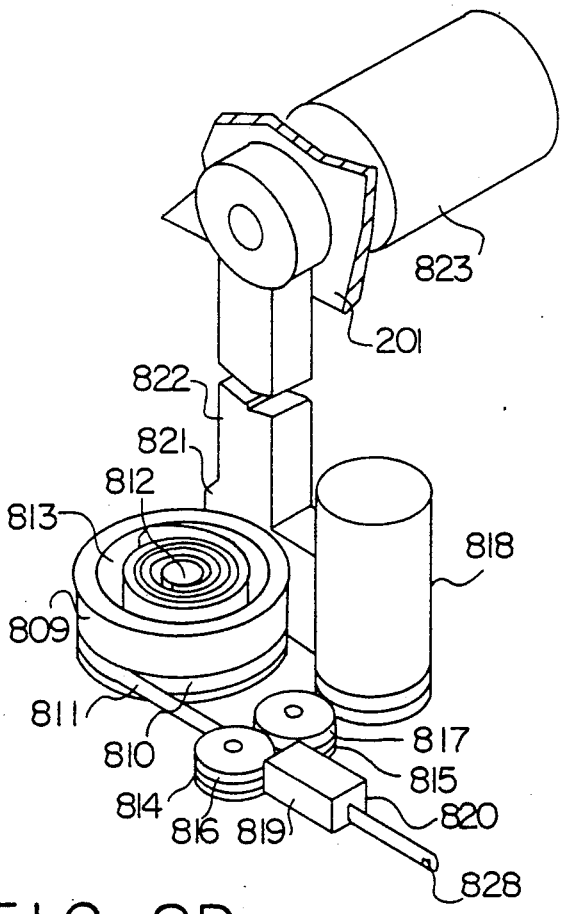
FIG. 8A represents an elevation view of the device for drawing in the thread through the heddle and the reed at a stage of its operation.
FIG. 8B represents a ground view of the actuation of the same heddle drawing-in device and the reed, with the system for selecting the harness for drawing-in also being indicated.
FIG. 8C is a view of a portion of the guideplate for drawing-in the heddle with a section indicating the cone shape which facilitates its being introduced among the warp threads and the means to turn the heddle eye.

FIG. 8D i.e. a perspective view of the device for catching the yarn and drawing it in through the heddle.

Figure 9A:
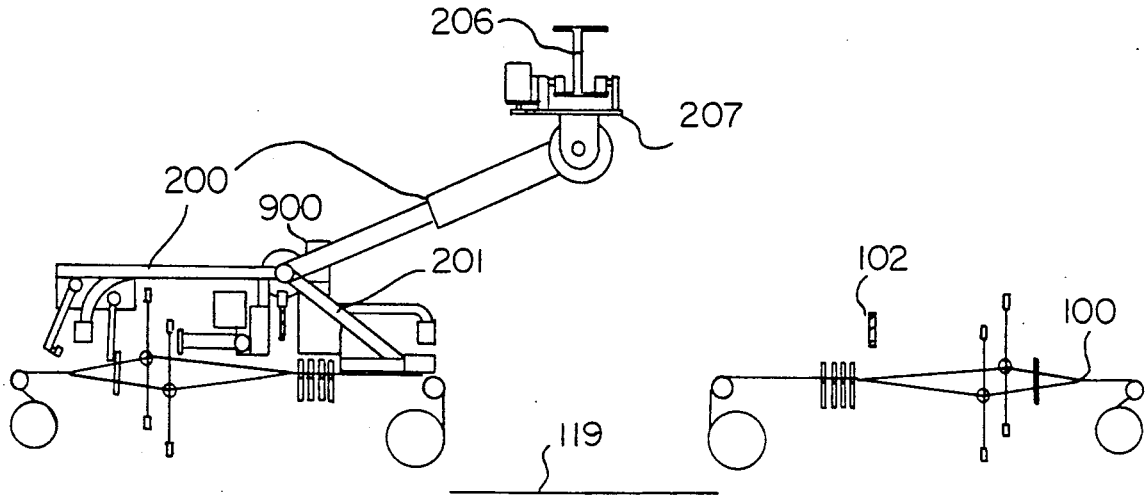

FIG. 9A represents an example of transport means for the repairing apparatus so as to fit it on a weaving machine.

Figure 9B:
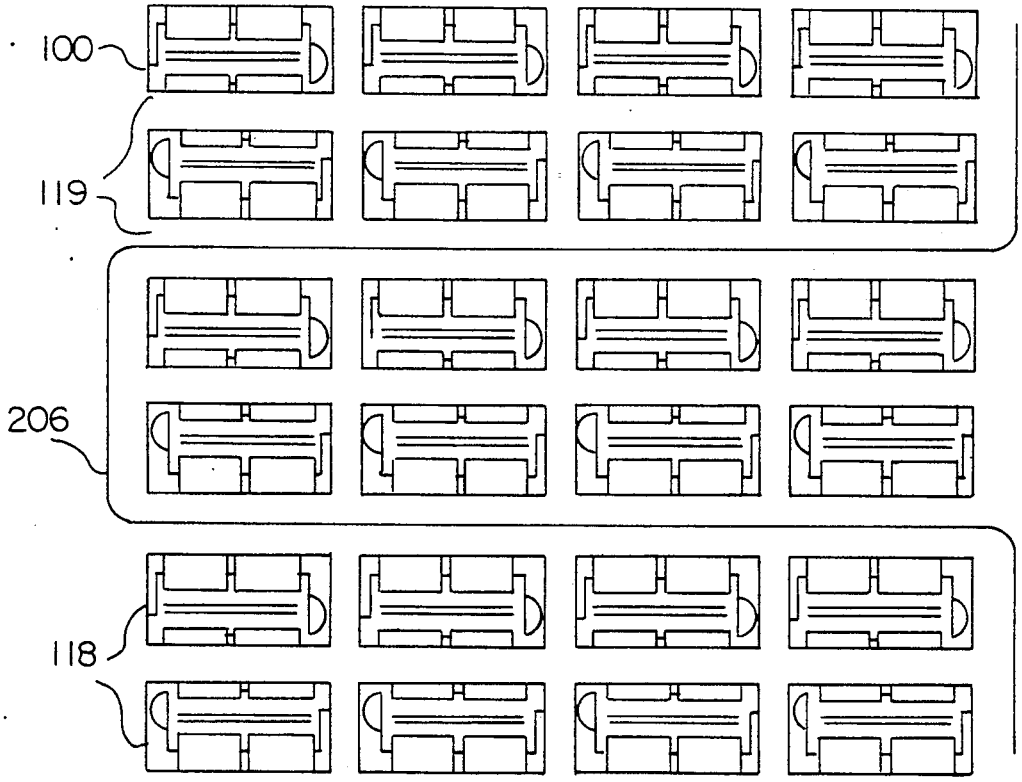

FIG. 9B represents a ground plan of a weaving room with a transport line system for the repairing apparatus being indicated.

DESCRIPTION OF THE APPARATUS

Figure 1:
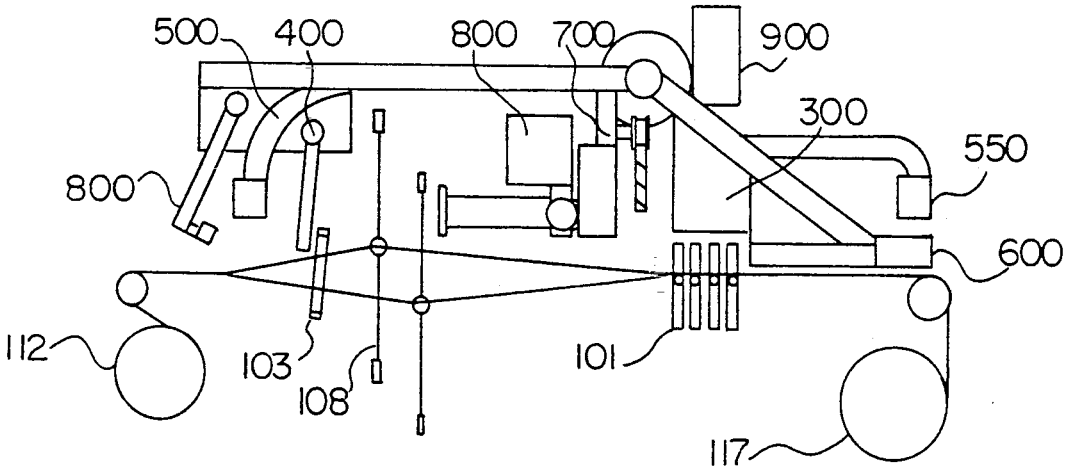
FIG. 1 represents the overall arrangement of a repairing apparatus of the present invention applied to a weaving machine or loom.

As shown in FIG. 1, the apparatus is made up of a frame -201- in which it has the different devices for fulfilling its mission: device -300- for counting drop wires; device -400- for counting reed spaces: device -500- for removing the broken end which extends to the cloth and for retaining and tensing the auxiliary yarn drawn into the reed in the cloth and cutting the excess once it has been joined; device -550- for extracting the broken yarn which extends to the warp beam; device -600- for selecting and feeding an auxiliary yarn of the same characteristics as those of the broken end and its joining with the broken warp thread; device -700- which draws the auxiliary yarn, already joined to the broken end, into the drop wire; device -800-which picks up the auxiliary yarn from device -700- and draws it in the harness and in the corresponding reed space, and the control system -900- for the entire equipment and its devices.

Figure 2:
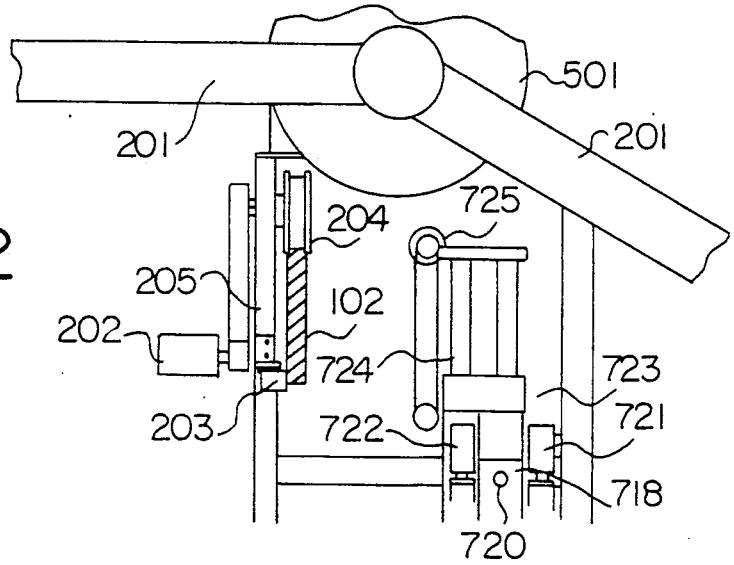
FIG. 2 is a view of the means for supporting and transporting the frame of the apparatus working on a weaving machine.

The frame -201-, FIG. 2, of the apparatus is joined to a plate -205-in which there are some wheels -204- suitable for turning on a rail -102-fitted on to the loom -100-, with the wheels being kept on the rail by means of the support rollers -203- joined to the plate -205- which are supported laterally against the rail -102-. One of the two wheels -204-turns freely on its shaft while the other is driven by a gear motor -202-(double speed, normal and slow) for its displacement on the rail -102-placed over the weaving machine -100-.

Figure 3:
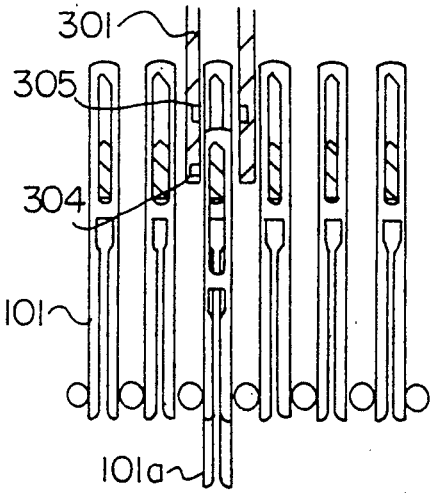
FIG. 3 represents the drop wire detecting-counting device.
Figure 7B:
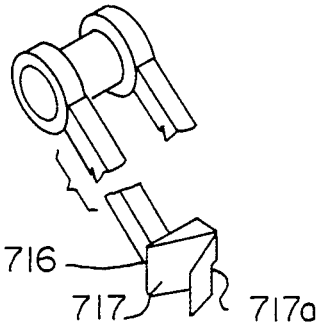
FIG. 7B is a detail of the strip guide linked with the frame.

The device -300- shown in FIG. 3, for counting drop wires -101- and locating the one corresponding to the broken end is joined to the apparatus and is made up of a sensor counter -301- (electro-mechanical, opto-electronic, inductive, magnetic, or the like). In the hypothesis contemplated in this case, the sensor represented is opto-electronic and is made up of two mini reflection photocells -304- and -305- located on the same vertical line, so that the lower one -304- will count the drop wires in all cases while the upper one -305- will not count the drop wire which has brought about the stop as it is not in the zone covered by same. Both are connected to high speed counters and supported by part -301- which is linked to part -302-, which slides on some horizontal shafts -303- as shown in FIG. 7E. This displacement is obtained by means of a stepping motor and normal transmission means or by any other conventional means.

Figure 4A:
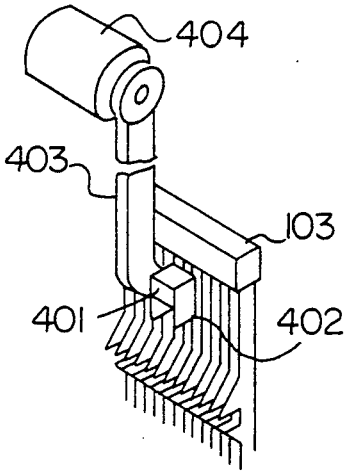
FIG. 4A represents the reed space counting device using an opto-electronic sensor.

In the part of the apparatus which coincides with the front part of the weaving machine, FIG. 4A, the reed space counting device -400- is installed, it being made up of an opto-electronic sensor -401-which is inseparably joined to and exactly aligned with a part -402-. This part -402- consists of a strip guide with a wide inlet and an exit which is level with the reed -103- just for the passage of the strip -801- which will be discussed further on. The whole of the two parts -401- and -402- is linked at one end of an arm -403- which is joined by its other end to the shaft of a motor-driven reducer -404- fitted into the frame of the device. The joining of the arm -403- with the shaft of the motor-driven reducer -404- is carried out by means of an elastic system which facilitates the positioning of the sensor -401- and guide -402- on the reed -103-.

Figure 4B:
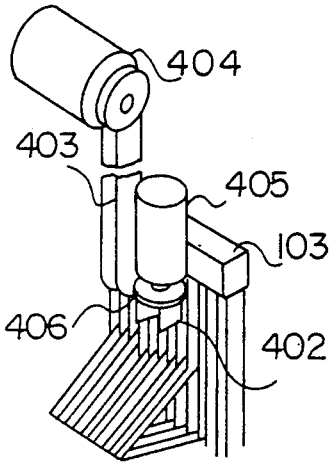
FIG. 4B represents the reed space counting device using an encoder.

Another alternative for counting the reed -103- spaces, see FIG. 4B, consists of using an encoder -405- on whose shaft a gear wheel -406- with the same pitch as that of the reed -103- is joined, and which serves as a rack for the movement of the encoder -405-. Naturally the strip guide part -402- is connected to the whole reed space counting device, and its openning is aligned with the shaft of the gear -406-. Another alternative for obtaining this same count is the use of a cylinder covered with a non-slip material which substitutes the gear -406- in the encoder shaft, then computing the distance measured by the encoder -405- so as to determine the number of reed spaces in relation to its passage. All these alternatives serve for determining precisely the reed space corresponding to the broken end as will be seen in the explanations which will be given further on.

Figure 5A:
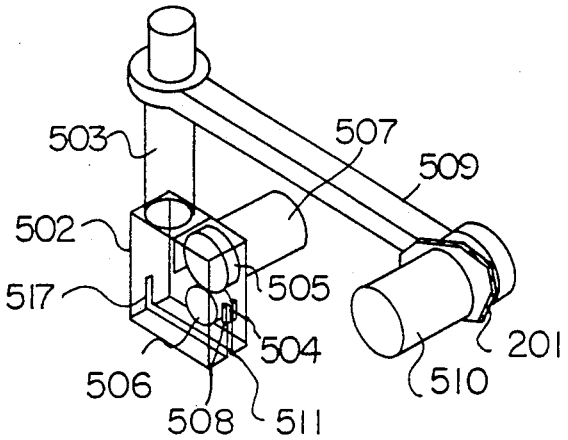
FIG. 5A represents the front broken thread extracting device.

The front broken end extractor -500-, FIG. 5A, which is so called as it operates on the front part of the weaving machine, is made up of a box -502-, to one of whose sides a suction tube -503- is connected and on another side, preferably the opposite one, there is an opening -511-which extends over the entire length and continues on a portion of the adjacent sides -517-. Inside the box -502- there are two rollers -505-and -506- which rotate tangently to each other. The upper roller -505-is covered with rubber and receives the movement from the motor -507-outside the box, onto whose shaft it is connected. The lower roller -506-receives its movement from the upper roller -505-. The guiding parts -504- serve to direct the extracted thread towards the rollers. An opto-electronic sensor -508- or an equivalent sensitive microswitch serve for detecting the beginning and the end of the operation. The box -502- is inseparably joined to one end of an arm -509- whose other end is joined to the shaft of the motor-driven reducer -510- fitted on the frame -201- of the apparatus -200-.

Figure 5C:
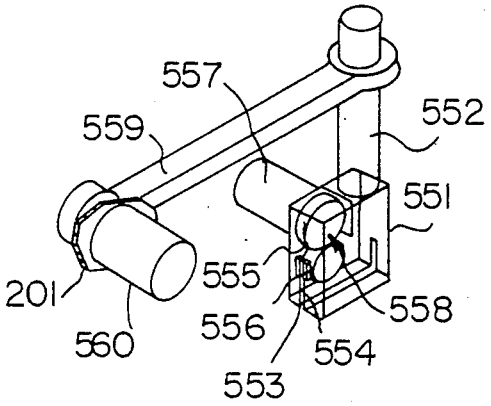
FIG. 5C represents the rear broken thread extracting device.
Figure 5B:
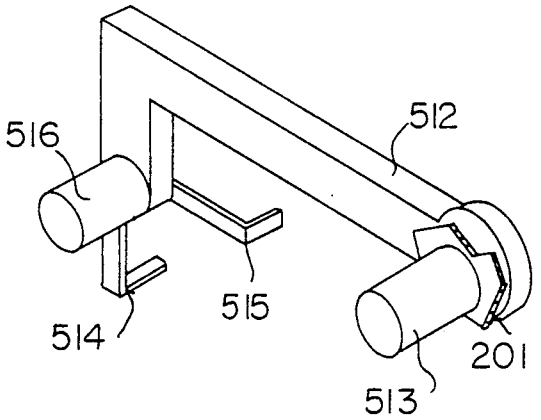
FIG. 5B represents the organs for cutting the broken end from the cloth and the retaining and cutting of the auxiliary yarn.

At the end of another arm -512- FIG. 5B also fitted in the shaft of a motor -513- which is mounted on the frame of the apparatus there is a clip-knife -514- which can come to rest on the surface of the cloth -112- while a counterblade -515- is joined to an arm attached to the shaft of a motor-driven reducer -516-. This motor-driven reducer -516- is in turn joined to the arm -512-, this whole thus constituting some means for retaining and cutting the thread from the front thread extractor -500-. The rear thread extractor -550-, FIG. 5C also consists of a box -551-which is connected to the suction tube -552- and which is provided with a longitudinal opening -553-. Inside the box -551- there are some rollers -555- and -556-, the first of which -555- receives the movement from the motor -557- joined on the outside to the box -551- and the second -556- receives it from the upper roller -555. There are also the guiding parts -558- and the sensor -554-. The whole is joined to the end of an arm -559- whose other end is joined to the shaft of a motor-driven reducer -560- which is joined to the frame -201- of the apparatus.

Figure 6C:
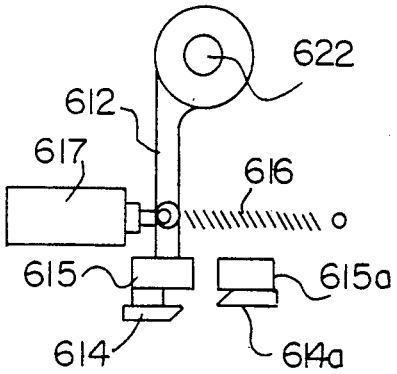
FIG. 6C is a view of a shear which retains the auxiliary yarn and cuts it off when the yarn length is sufficient.
Figure 6A:
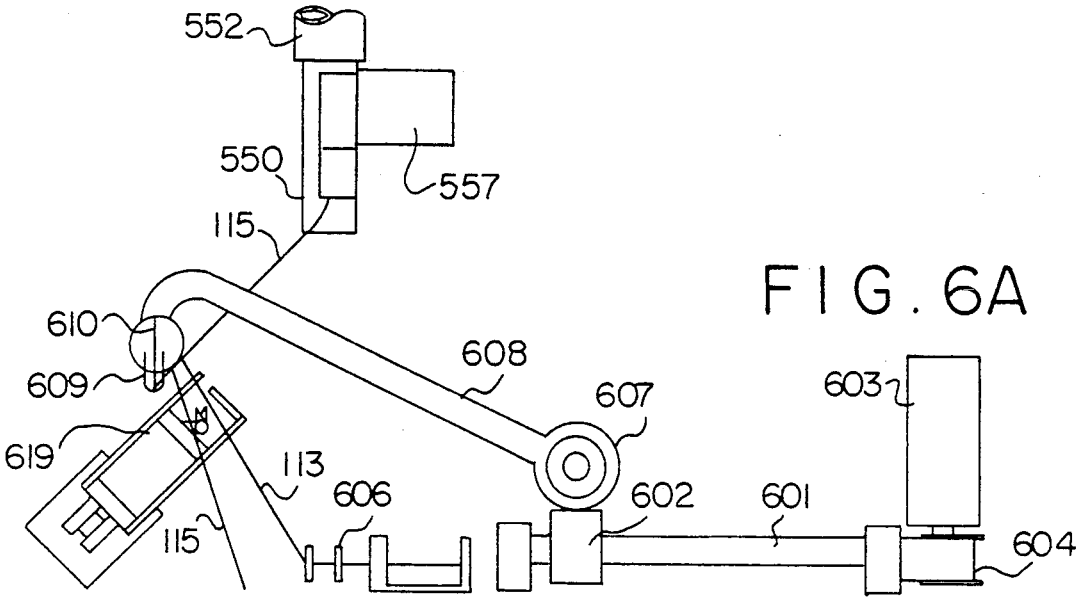
FIG. 6A is an elevation view of the device selecting the auxiliary yarn and joining it to the broken warp thread.
Figure 6B:
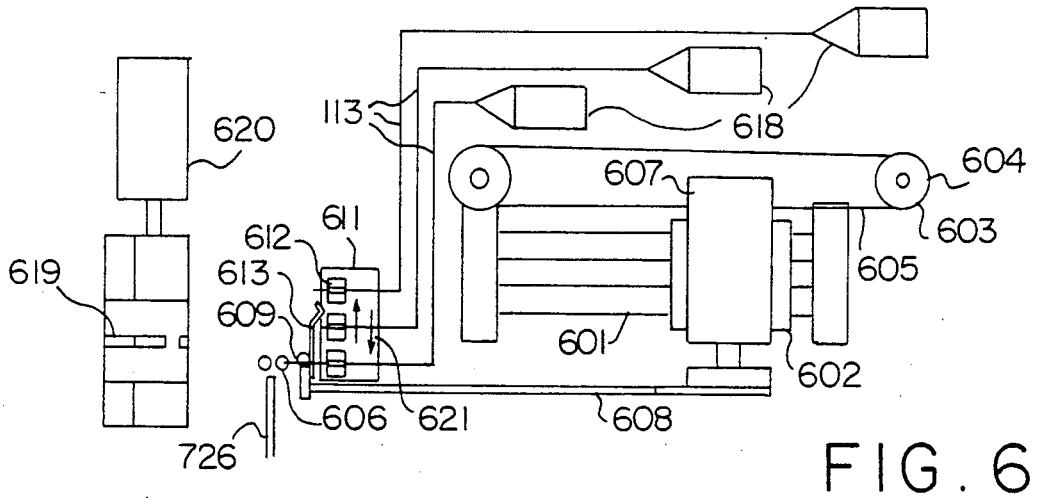
FIG. 6B is a ground view of the device of FIG. 6A.

The device -600- for selecting and feeding the auxiliary yarn -113- FIG. 6A and FIG. 6B and the means for joining the latter to the broken warp thread removed by the device -550- is located in the rear part of the frame -201- of the apparatus, with this position coinciding with the rear part of the weaving machine -100-. Firmly fixed to the frame -201- of the apparatus there are some horizontal guides -601- on which a part -602- moved by the motor -603- and the pulleys -604- and belt -605- slides. On this part -602- the motor-driven reducer -607- is attached, to whose shaft an arm -608- has been fixed. At the end of the mentioned arm -608- a nipper -609- is attached, whose opening is carried out by means of an electromagnetic coil -610-. By the nipper -609- an extension -613- is included, and it is capable of picking up the broken warp thread absorbed by the extracting device.

In the same horizontal plane and in the direction perpendicular to that of the movement of the nipper -609-, a flat section -611- slides, moved by a stepping motor, in the direction shown by the double arrow -621- which has a determined number of clip-knives -612-. FIG. 6C. Each one of these clip-knives -612- is made up of a shaft -622- in which one of the cutting blades -614- of the knife is linked, and to which the moving gripper -615- of the nipper has been fixed, while the other blade -614*a*-of the knife and the gripper -615*a*- are fixed on to the flat section -611-. The shears and mentioned grippers are usually closed by the action of a spring -616-, and can be opened by the action of the electromagnetic coil -617-. Each one of these clip-knives -612- carries a thread -113- which corresponds to the different colors, materials, count and actual characteristics of the threads making up the warp which is being manufactured on the weaving machine which is the object of the repair work. The mentioned auxiliary yarns come from a mini-creel -618- carrying some coils which is also supported by the rear frame of the device. On the same frame and almost coinciding with the end of the stroke of the nipper -609- a knotter device -619- is attached, and it is driven by an electromagnet -620-.

Figure 7A:
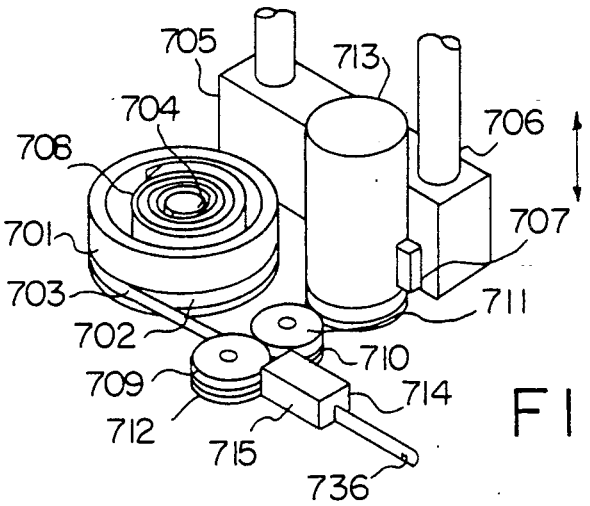
FIG. 7A represents the device which includes the steel strip and its pulling means for threading the drop wire.

The threading device -700- on the drop wire, FIG. 7A, is made up of a hollow cylinder -701- on whose periphery there is a groove -702- in which a fine flat strip of steel -703- is housed, one of whose ends is attached to the cylinder -701-. This cylinder can turn around a vertical shaft -704- which is supported by a sliding part -705- which moves on some vertical guideways -706- due to the action of a motor and its conventional traction elements.

Inside the cylinder -701- a spring -708- is housed, which is joined by one of its ends to the inside part of the cylinder -701- and by the other end to the fixed shaft -704- with which the steel strip -703- tends to coil in the groove -702- of the periphery of the cylinder -701-. This steel strip -703- has its outer free end which passes between two friction cylinders -709- and -710- moved by the gears -711- and -712- and by the motor -713- and by the guideway -714- incorporated in an opto-electronic stroke sensor -715- or any other similar or equivalent means. Both the cylinders -709- and -710- and the motor -713-, sensor -715- and guideways -714- are supported by a part -707- which is joined to the slide -705- and which supports the cylinder -701-. Another element in the threading device -700- of the drop wires is the strip guide -716- FIG. 7B and 7D which is linked to the frame -201- of the apparatus. The mentioned strip guide -716- goes between the rows of drop wires -101- almost level with the warp, and has a wide inlet -717- and a narrow outlet -717*a*- so as to guide the strip -703- properly.

Figure 7F:
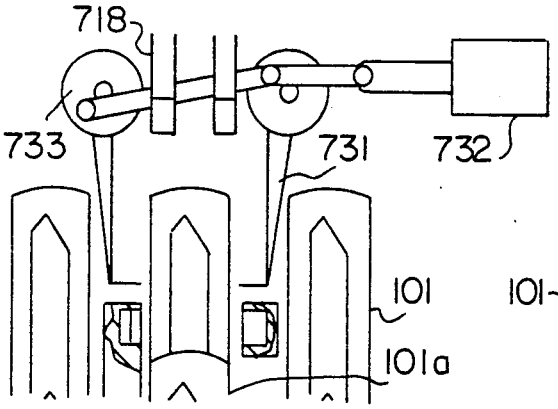
FIG. 7F represents the delta parts which act on the drop wire in their non operative position.
Figure 7G:
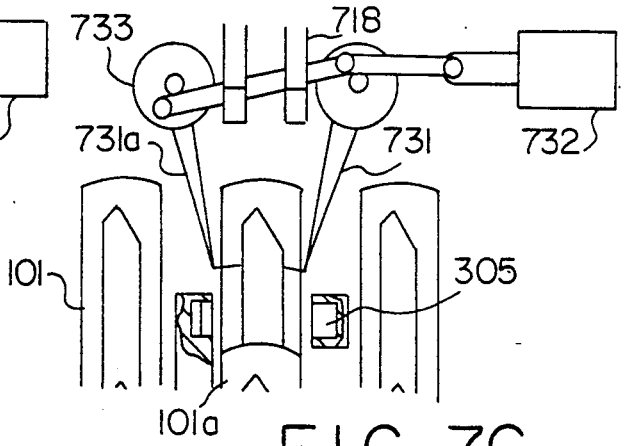
FIG. 7G represents the delta parts which act on the drop wire in their operative position.
Figure 7C:
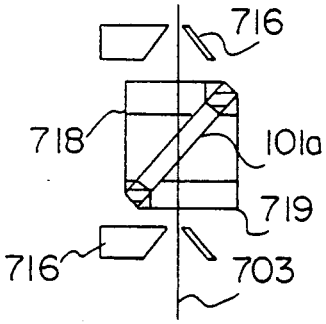
FIG. 7C is a view of the drop wire between two adjacent strip guides.

Another element in the threading device -700- for the drop wire is made up by parts -731- and -731*a*- of FIGS. 7F and 7G associated to the drop wire -300- counter. These parts -731- and -731*a*- can turn on the supports -733- and the end of their arm has a delta shape, with its tip corresponding exactly to the vertical plane which passes through the center of the reflection photocells -304- and -305-. Both parts -731- and -731*a*- can go from an inoperative position to an operative position by means of the action of the electromagnet -732-. Another element in the threading device -700- are the separating lifting parts -718- and -719- which FIG. 7D–7E slide along the horizontal guideways -720- due to the action of their respective motors -721- and -722-. The horizontal guideways -720- are supported by another sliding part -723- which moves on some vertical guideways -724- which are attached to the same sliding part -302- which the drop wire counting sensor device -300- has.

The sliding part -723- is driven on its vertical guideways -724-by the motor -725- and traditional transmission elements such as belts and pulleys. The parts -718- and -719- can be moved independently on the guideway -720- and be separated or brought together as they are actioned by different motors. This parts are sufficiently long so as to be able to descend to a position below the plane of the warp.

Figure 7D:
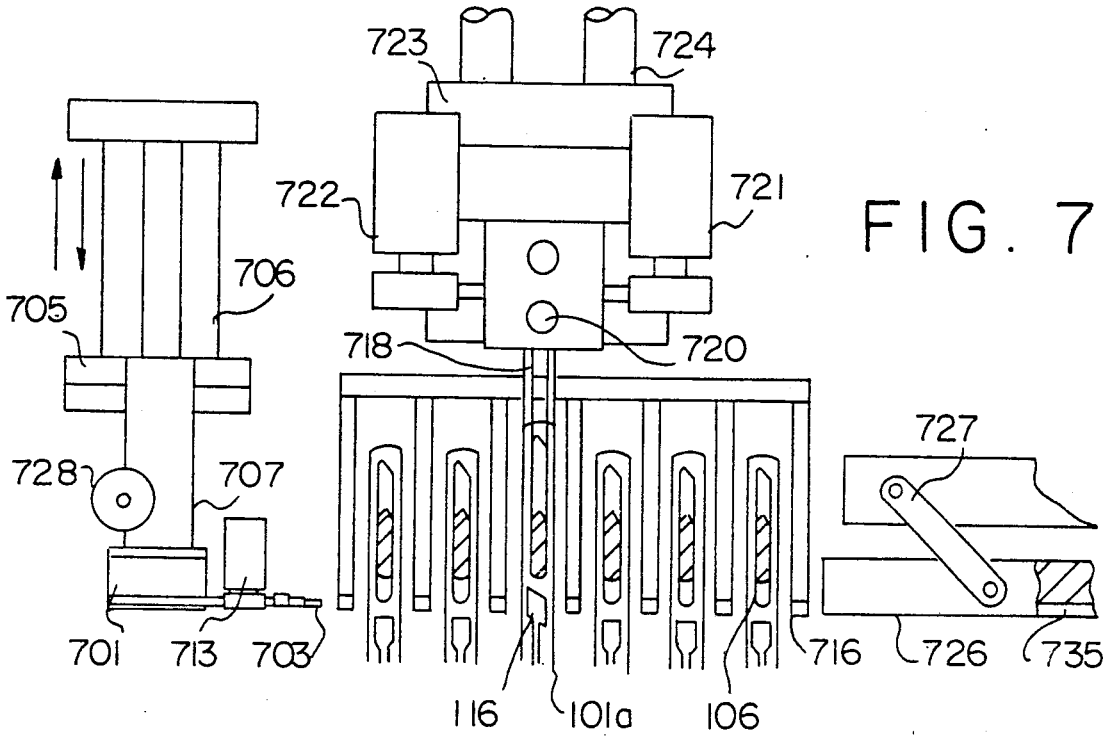
FIG. 7D is a general view of the drop wire threading device.
Figure 7E:
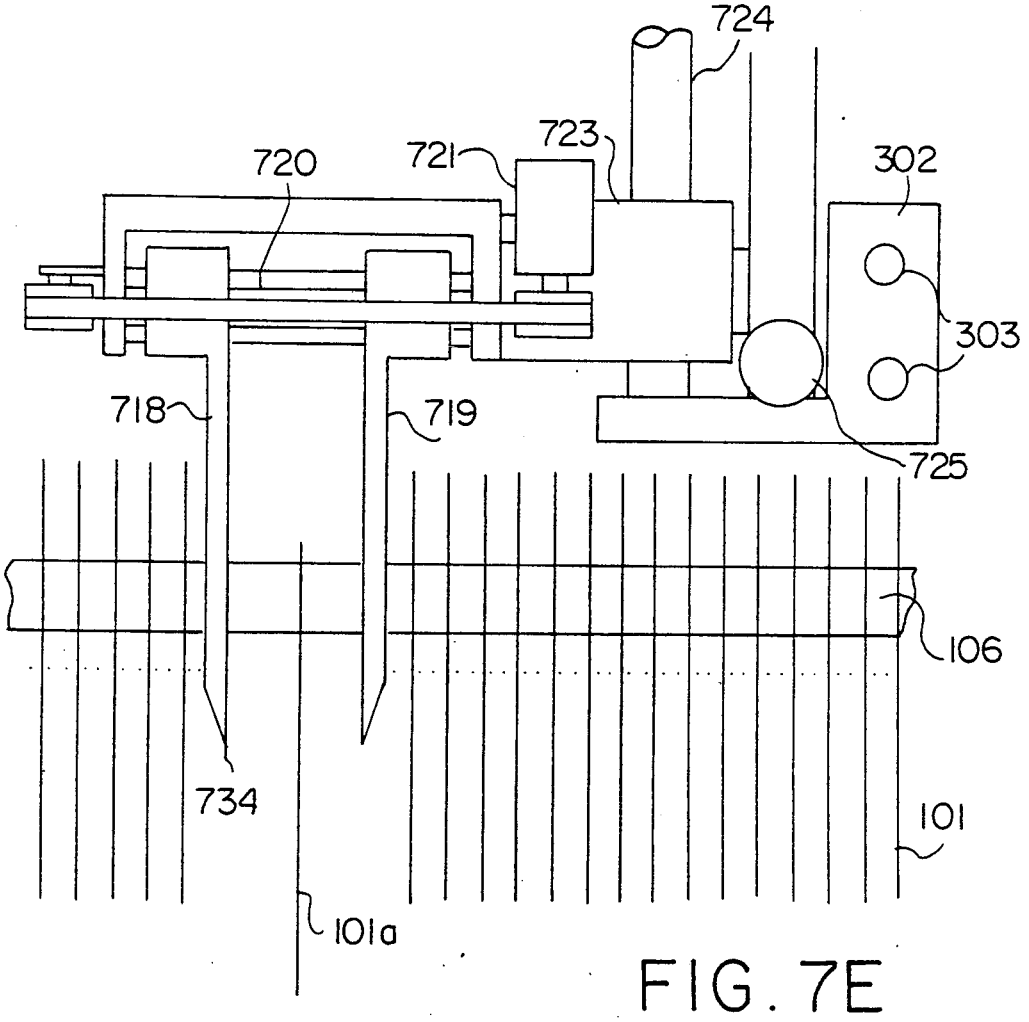
FIG. 7E represents the means for raising and positioning the drop wire for it to be threaded.

Another element in the threading device -700- is the guideway -726- FIG. 7D which extends from the strip guide -716- elements outlet between the drop wires up to the rear part where the warp thread has been knotted with the auxiliary yarn -113-. This guideway -726- consists of a rule which has a groove -735- on the side which is closest to the warp and which is sufficiently wide and deep so as to allow the passage of the steel strip -703-. Moreover, due to the parts -727- in which it is linked, it can be provided with a descending movement which allows it to place itself at the same height corresponding to the steel strip -703- when it takes its active position, and to move from the warp surface when the device is moved.

Figure 8C:
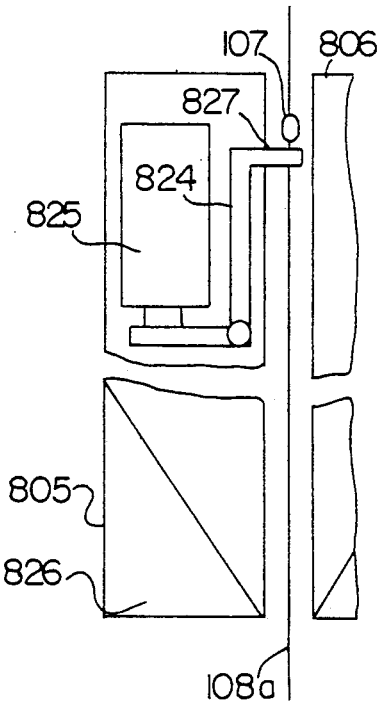
Figure 8A:
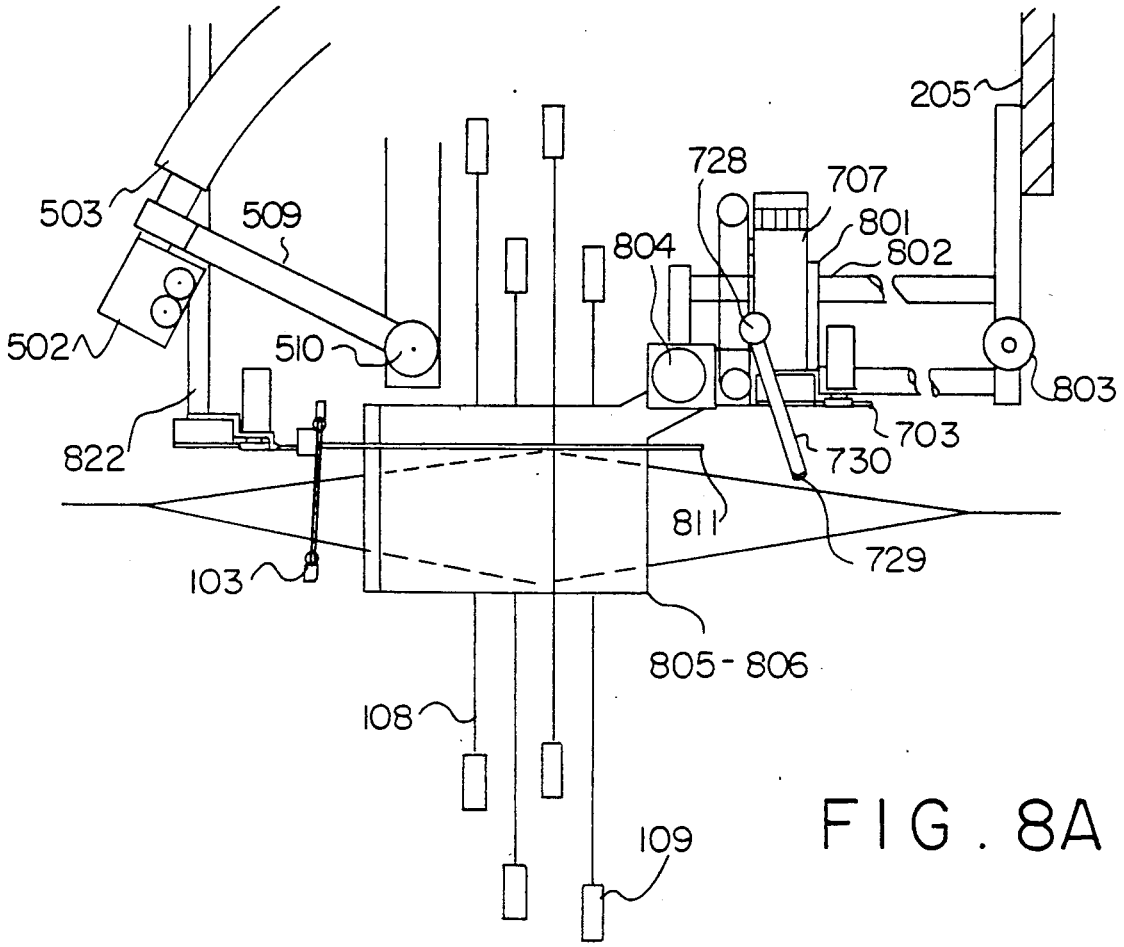
Figure 8B:
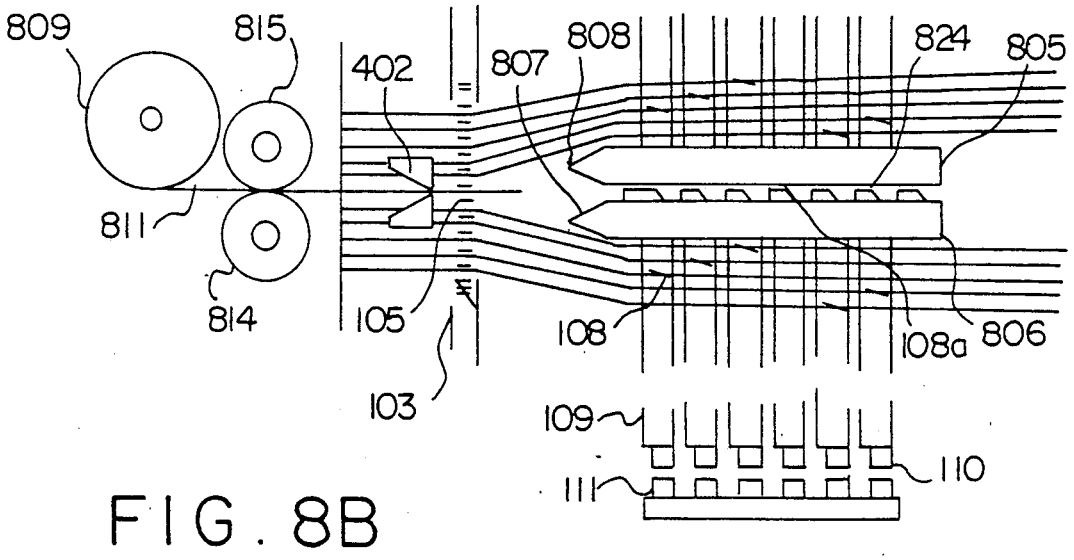

Finally, another element in the threading device -700- is the one which serves for transferring the thread picked up by the steel strip -703- to the drawing-in device -800-. See FIG. 8A; it consists of a motor-driven reducer -728- attached to the slide -705- on whose shaft an arm -730- has been attached to the end of which there is a slant catching slot -729- and which, in its circular movement, can move the mentioned end from a position near the strip -703- tip to another position near the tip of strip -811-. The drawing-in device -800- for the auxilliary yarn through the heddle -108*a*- and the space -105- of the reed -103- FIG. 8A and 8B is made up of a sliding part -801- which moves on some horizontal guideways -802- which extend from the base plate -205- of the apparatus to the proximity of the harness -109-. This slide -801- is actioned by a motor-driven reducer -803- with its corresponding pulleys and belts or its equivalent transmission means. As well as having the vertical guideways -706- of the threading device -700- of the drop wire attached to it, and consequently all the mechanisms of same supported by its slide -705-, the mentioned part has a motor-driven reducer -804- attached to it, on whose shaft the ends of two plates -805- and -806- are attached, whose length is equal to the thickness of all the harnesses -109- plus the distance from the first harness to the reed -103- on the threading position plus a separation which is slightly greater than the radius of the motor -804- in the rear position. Its approximate height corresponds to the maximum opening of the harnesses and its front side has some internal chamfers -807- so as to facilitate the entrance of the heddle -108*a*- as well as other external chamfers -808- to avoid the collision with the adjacent heddles and set aside to the heddle -108*a*- which has been put in. In the lower part of the rear zone of the plates -805- and -806-, there is a bevel -826- FIG. 8C so as to facilitate its introduction between the warp threads. These two plates -805- and -806- are separated just enough to allow the heddle -108*a*- FIG. 8B and 8C through. The external sides of the plates -805- and -806- are smooth and fine, as are their internal sides so as to allow the heddle -108*a*- and thread -113- to slide. On one of these sides and at a height slightly above the eye -116- of the heddle -108*a*- there is a longitudinal groove -827- through which, once the heddle has been put between the plates -805- and -806-, a part -824- comes out, actuated by a coil -825- which obliges the heddle -108- a to turn so that the latter has the maximum surface of its eye -116- with the object of facilitating threading. Another element making up the device -800- for drawing the auxiliary yarn through the heddle -108- and through the space -105- of the reed is made up, the same as in the case of threading the drop wire, of a hollow cylinder -809- on whose periphery there is a groove -810- which houses a fine, flat steel strip -811-, one of whose ends is attached to the cylinder -809-. This cylinder -809- can turn round a vertical shaft -812- and inside the same cylinder -809- there is a spring -813- joined by one of its ends to the inside part of the cylinder -809- and by the other end to the fixed shaft -812- with which the steel strip -811- tends to coil, supported on the slot -810- of the periphery. This steel strip has a free external end which passes between two friction cylinders -814- and -815- (moved by gears -816- and -817- and motor -818-) and by the guiding part -819- which incorporates an opto-electronic stroke sensor -820- or a similar organ. Both the rollers -814- and -815- and the motor -818- and the guiding part -819- are supported by a part -812- which is attached to the end of an arm -822-. The other end of the mentioned arm -822- is attached to the shaft of a motor-driven reducer -823-firmly fixed to the frame -201- of the apparatus and precisely in the part coinciding with the front part of the weaving machine -100-.

As can be seen in FIG. 9B, in a weaving room with numerous weaving machines -100- arranged in rows -118-, a stationary support line -206- is mounted, which may be, for example, a guiding rail -206- which is arranged to extend between the aisle -119- of the rows -118- of the different weaving machines -100-. This support line -206- has some transportation and displacement means -207-, for example FIG. 9A, a mobile motorized carriage -207- controlled by the control system -900-, and the mentioned carriage -207- transports the frame -201-. The mentioned frame -201- carries at least some of the devices -300-, -400-, -500-, -600-, -700-, -800-, -900- which make up the apparatus. Due to the orders from the control system -900-, it is placed on the guiding rail -102- installed in the weaving machine -100- so as to carry out all the reparis which are described in this report at a local level.

The control system -900- which in the example described is called, at least partially, a PLC (programmable logic device) control device, may be made up of one or several elements, some fixed ones and the others mobile ones, for example supported by the actual frame -201- of the apparatus so as to reduce the lengths of the electrical connections carrying the information and orders from one part of the apparatus to another.

It is also included that the data transmission system may be wireless, for example by radio and using coded messages for each one of the operations or operation sequences to be carried out.

DESCRIPTION OF THE PREPARATION OF THE WEAVING MACHINE

As we have said above, the apparatus is combined with some auxiliary means for the correct positioning of the weaving machine. For using the broken warp thread repair apparatus on weaving machines, the weaving machine must be stopped in a way other than that which is usually used. It is known that when repairs have to be carried out by hand, the loom is prepared so that it stops with the harnesses flat (when all the warp threads are horizontal) so as to facilitate the operation. With the automatic apparatus -200- it is necessary that the position of the weaving machine, when it stops, is with the reed separated from the cloth and with the minimum sufficient for the elements in the devices -400- and -500- situated between the reed and the cloth to operate, with a semi-open shed. On the other hand, it is necessary that the harness to which the heddle -108*a*- to be drawn-in corresponds is situated in the upper part and at a prefixed height which is the same for all cases, which is obtained by setting a sensor -110- FIG. 8B (magnetic, inductive, capacitative or similar) to an end of each frame -109- and an activating organ -111- fixed to the loom -100- opposite a determined point in its stroke, or vice versa. In this way, the different devices in the repairing device may be operated suitably and they will have space for doing so as the harnesses -109- and the reed -103- are duly positioned.

OPERATION OF THE APPARATUS

When a warp thread breaks in the weaving machine -100- the drop wire -101*a*- falls and the machine stops on the position predetermined by the auxiliary positioning means previously mentioned. At the same time, the stop signal is given and it is received by the control equipment (PLC) -900- of the repairing apparatus and the apparatus goes to this machine, in the event of all or part of it not being fixed to the same. At the same time, the apparatus is in relation with the memory of the control system -900- which contains all the information on the cloth and the machinery which is necessary for carrying out the repair. The signal received includes as information the row of drop wires where the drop wire -101*a*- is that has brought about the stop. With this information, the motor moving the drop wire sensor-counter -301- starts up to occupy the correct position so as to enter precisely in that row. Once the apparatus is positioned with its wheels -204- on the rail -102- belonging to the weaving machine -100-, the motor -404- turning the arm -403- starts up and places the opto-electronic reed space sensor-counter -401- and the strip-guide part -402- on the surface of the reed -103- and a sufficient distance away from the first reed space occupied by the warp. When the drop wire counter -301- starts counting the drop wires, the reed space counter -401- takes a few centimeters of its travel to reach that first reed space occupied by the warp where it must start counting the mentioned spaces. This effect is achieved on covering the reed surface where the sensor -401- is placed by means of a plate up to the first mentioned usable reed space, the first point where it must start counting the mentioned spaces.

As has been said, the motor -202- driving the apparatus on the rail -102- is started up, and the sensor-counter -301- penetrates into the corresponding drop wire row. This sensor starts to count from the first drop wire in the row. When the lower sensor -304- does not correspond to the upper one -305- due to the fact that it has reached the drop wire -101*a*- which has fallen, the displacement and counting stop. Thus the counting device has positioned itself opposite the drop wire -101*a*-corresponding to the thread requiring repair. With the number obtained in the counting of the drop wires, the electronic control device (PLC) together with the information the mentioned control system -900- has stored regarding the composition of the warp and its drawing in through drop wires, harness heddles and reed, as well as selvages determines the characteristics of the broken thread (colour, count, twist, material, characteristics and similar points) as well as the harness in which the heddle is in which the broken thread was drawn and also the space -105- of the reed -103-through which the same passed. In accordance with this information, the mentioned PLC control device will give the orders to the different devices in the repairing apparatus and auxiliary means in the weaving machine so that the following operations are carried out. As a consequence of these orders, the coil -732- makes the delta parts -731- go in between the two immediate drop wires adjacent the fallen drop wire -101*a*-, separating them enough so that the ends of the lifting parts -718- and -719- can go in together. At the same time, the motor-driven reducer -725- starts up, making the sliding part -723- come down, and consequently the parts -718-and -719- which are precisely on the vertical shaft of the sensor-counter -301- and consequently of the drop wire -101*a*-. When the parts -718- and -719- have gone down sufficiently so as to be in the space opened by the parts -731- and are situated between the drop wires neighboring -101*a*- which has brought about the stop, their descent is stopped. The delta parts -731- return to their original position when the action of the electromagnet -311- ceases, and the motors -721- and -722- start up, which drive the parts -718- and -719- in their horizontal movement in such a way that these parts are sufficiently separated from each other so that in the new descent, the drop wire -101*a*- is situated between the two parts -718- and -719-. When the horizontal movement of the lifters -718- and -719- has stopped, their descent movement recommences brought about by the motor-driven reducer -725- until their lower end is close to the warp plane. The descent movement is stopped again and the motors -721- and -722- start up, but this time in the direction for bringing the lifters -718- and -719- together.

They leave a minimum distance between each other so that their internal sides can slide on the sides of the drop wire -101*a*- which is trapped between them. When the lifters -718- and -719- stop in their horizontal drawing together movement, the vertical descent movement of the unit is commenced by the means mentioned above, and thus, upon the sliding of the lifters -718- and -719- on the surface of the drop wire -101*a*-and due to the bevel shape -734- of the end of the drop wires, the drop wire -101*a*-is separated from the immediate lateral warp threads. When it has descended enough, the ascent and descent motor -725- stops and the motor -202- of the apparatus -200- starts up slowly, and likewise motors -721-and -722-, with the latter tending to displace the parts -718- and -719-in the opposite direction to the displacement of the apparatus, giving it an equivalent speed. Thus the lifting parts -718- and -719- and consequently the drop wire -101*a*- held back between them are made to stay in their original position suitable for the drop wire -101*a*- to be threaded later. When the movement of the apparatus recommences, the sensor-counter -401- of the reed spaces continues to count them until the number reached is equivalent to that which the control unit -900- has computerized which was the one which corresponded to the broken thread. The device stops when the sensor-counter -401- and consequently the guide -402-which is attached to it are exactly in this space -105- corresponding to that of the broken thread.

Once the control unit -900- has determined the stopping of the displacement motor -202-, it starts up the motors -721- and -722- in opposite directions, so that the lifters -718- and -719- move from the drop wire -101*a*- and consequently separate the immediate lateral wrap threads from the drop wire and the broken thread, leaving sufficient space between the same so that the extraction and drawing-in action can be carried out more easily.

Once the previous operation is completed, the motor-driven reducer -510-is started up, which, by means of the arm -509- driven by its shaft, places the front broken thread extractor -500- on the upper shed. At the same time, the exhaust fan -501- has been started up, which directs its action through the pipe -503- to the mentioned extractor -500-. The suction lifts up the broken thread which penetrates through the opening -511- and is directed (by the guides -504-) towards the rollers -505-and -506- which pull the loop-shaped broken thread inside the suction pipe -503-. The sensor -508- controls the completion of the extraction (which can also be carried out by timer). At the end of this operation, the extractor -500- is lifted up by the arm -509- of the motor -510- sufficiently with regard to the shed surface so as to give way to the knife -515-which is driven by the motor-driven reducer -516-. This knife -515-passes beneath the extractor -500- and approaching the counterblade -514-it stops and they go down together through the action of the motor -513-which is assembled on the arm -512-, until reaching the surface of the cloth -112-. When the motor -516- which drives the knife -515- starts up again, this knife cuts the thread caught between both knives -514- and -515- level with the surface of the cloth, with the piece of cut thread being absorbed by the suction of the exhaust fan -500-. At the same time as the motor -510- which positions the front exhaust fan is started up, the motor-driven reducer -560- is also started up, which positions the rear thread extractor -550- on the surface of the warp near the loom thread guide in the area where the broken warp end is. As with the front extractor, the thread is taken in sufficiently so that it goes between the driving rollers -555- and -556-, with the thread being introduced inside the suction pipe -552- in a loop shape until the operation is considered to have been completed when its end has gone through the sensor -554-. The extractor -550- rises, keeping the thread inside due to reduced suction in such a way that it can be picked up and transferred to the knotter device -619-.

In the extraction of broken threads both from the front and from the rear, if there is a tendency in the warp threads to the "clinging" effect, the operation must be carried out with flat harnesses and with them preferably having a small movement so as to facilitate the work of the driving rollers -555- and -556-. Next the motor -607- of the selecting and knotting device -600- starts up FIGS. 6A–6B making the arm -608- descend, on whose end there is the nipper -609- which opens due to the action of the coil -610-when in its movement it is positioned near the corresponding clip-knife -612-. This clip-knife -612- FIG. 6C has been selected by the PLC control device -900- for retaining the end of the auxiliary yarn -113-, whose characteristics are the same as those of the broken thread.

The downward movement of the nipper -609- continues until the selected thread -113- is between its grippers. Then the descending movement stops and the coil -610- stops actuating, and thus the nipper closes, with the end of the thread -113- being retained by the nipper -609- at the same time as the gripper shear -612- opens, and from then on the thread can be pulled with the nipper -609- when the latter moves by means of the motor -607- and by the action of the motor -603- which moves the horizontal sliding part -602-. At the same time as the nipper -609- moves horizontally, it has two descent-ascent movements produced by the motor -607-. With these movements, the auxiliary yarn -113- is kept threaded inside the thread guides with brake -606-. The same is then lifted up with the combined horizontal transfer movement produced by the motor -603- and the ascent and descent movement produced by the circular movement of the motor -607-. The thread -115- retained by the extractor -550- FIG. 6A and which is pulled by the extension -613- and the auxiliary yarn -113- caught by the nipper -609- are put in the knotter device -619, which, through the action of the electromagnet -620-, knots them. The cut-off ends of the yarn are sucked up by the exhaust fan -550- suction pipe. Once this operation has been carried out and by the action of the motors -603-and -607-, the nipper -609- returns to its original position.

The drop wire -101*a*- threading operation, whose initial part, so as to abbreviate the cycle, may coincide with the final part of the selecting and knotting operation of the device -600- which we have just described, commences with the starting up of the motors -721- and -722- in opposite directions which makes the lifting parts -718- and -719- draw together until the drop wire -101*a*-is held between them. Once this movement is stopped, the motor -725- is started up, which brings about the vertical displacement of the lifters -718- and -719- and consequently the lifting of the drop wire -101*a*- held between the mentioned parts, up to the maximum height which its stroke allows with regard to the warp stop-motion bar -106- FIG. 7B and 7D. Next the motor-driven reducer -735- starts up, which transports the threading device -700- from its raised, inoperative position to an operative position by the warp place. Once the motor-driven reducer -713- is in its operating position, it starts up and the friction cylinders -709- and -710- pull the steel strip -703-outwards, opening it out with regard to the groove in the cylinder -701- and making it penetrate through the strip guide -716-. This strip -703- passes from one to another until it finds the eye -116- in the drop wire -101*a*-. As has already been explained, this drop wire -101*a*- has the maximum possible opening -116- due to the slanting of the walls FIG. 7C of the lifting parts -718- and -719-. Thus, the strip -703- passes through the opening in the drop wire -101*a*- and through the strip guides -716- that there may be after same. The mentioned strip -703- goes in the guide -726- which extends from the last row of drop wires up to the centre of the yarn guides -606- in which the auxiliary yarn -113- has been put and braked prior to being knotted with the thread -115- in the warp beam. The strip -703-, after passing the guide -726- surpasses the thread extended between the mentioned yarn guides -606-. The stroke sensor -715- of the strip -703- determines that the same will move in the opposite direction, that is, in the direction it is wound on the cylinder -701-. In this way, using the slanting slot -736- made in the end of the strip -703-, it takes and pulls the auxiliary yarn -113- knotted to the thread -115-in the warp beam, which unwinds from the corresponding coil of the feeding creel -618- and makes it pass with this return movement through the orifice -116- of the drop wire -101*a*-. When it reaches the starting point, its end is detected by the sensor -715- and the winding stopped. At the same time, by the action of the motor -725-, the sliding part -723- is raised and with it, the strip -703-, and all its traction and control elements. The lifters -718- and -719- are also separated from the drop wire -101*a*-and placed in their initial position by the action of their respective motors -721- and -722-. In relation to the depth of the weaving machine, the clipknife -612- will cut the auxiliary yarn -113- which has already been knotted to the thread -115- in the warp beam and has been caught and pulled by the end of the steel strip -703-. This cutting action must be carried out at such a point where it free end can be absorbed by the front exhaust fan -500- suction once it has been drawn in through the heddle -108*a*- and the space -105- of the reed -103-. The end of the auxiliary yarn -113- from the coil of the creel -618- is automatically caught by the nipper -615- incorporated with the knife -612- when the thread is cut. The motor-driven reducer -804- corresponding to the device for drawing the auxiliary yarn in through the heddle -108*a*- and through the reed space -105- starts up and with a 90 degree turn, places the plates -805- and -806- within the warp plane, and precisely between the threads next to the broken thread, by the effect of separation between the warp threads which has been carried out by the parts -718- and -719- when the latter were as far as possible apart.

Next the motor -803- starts up, which pulls the sliding part -801-(to which the motor -804- is attached, as well as its plates -805- and -806-) in the direction of the harnesses -109- of the weaving machine, with the plates -805- and -806- penetrating between the heddles -108-. These heddles -108- are, with their corresponding threads, positioned on both sides of the plates -805- and -806-, excepting the heddle -108*a*- which contained the broken thread, which, as it was not compelled by the thread to place itself on one side of the plates, penetrates between same with the ease given by the chamfers -807- on its front side. The plates -805- and -806-continue forwards between the harnesses -109-, whatever the harness which contained the heddle to be drawn in until surpassing the front line of the harnesses, stopping a short distance away from the reed -103-. At the same time as the plates' -805- and -806- going between the warp has been started, the motor -823- fixed to the front frame of the device -200-starts moving and detains the arm -822-. This arm -822- joined to its shaft stops in an appropriate position so that the steel strip -811-(with all its traction and control system attached to the other end of the mentioned arm -822-), is perfectly aligned both with the inlet of the guide -402- for the passage of the space -105- of the reed -103- and with the eye -107- of the heddle -108*a*- to be drawn in. Next the motor -818- starts up, which starts the friction cylinders -814- and -815- pulling steel strip -811- moving.

The mentioned strip -811-, directed by the guide -819- attached to the displacement sensor -820-, in introduced into the inlet guide -402- of the space -105- and crosses the reed -103-. After it enters the moving guide -824- between the plates -805- and -806- and goes through the eye -107- of the heddle -108*a*-, continuing along the guide -824- between the mentioned plates -805- and -806- until reaching the outer part of the same, also outside the harness -109- frame. Then the motor-driven reducer -728- starts up and the groove -729- located at the end of the arm -730- which is attached to its shaft picks up the auxiliary yarn -113- from the end of the steel strip -703- and places it near the steel strip -811- which, in its return movement, catches the mentioned yarn -113- by means of the groove -828- existing at its end. The mentioned yarn is pulled towards the internal guide of the plates -804- and -805- and threaded, being drawn in the eye -107- of the heddle -108*a*-. At the outlet of the plates, it is drawn in the space -105- of the reed until the sensor -820- stops the movement of the pulling motor and starts up motor -510-, when the end of the strip reaches its original position. The mentioned motor -510-brings the front broken thread extractor -500- up to the auxiliary yarn which has just been drawn in and which extends from the reed -103- up to the tip of the strip -811-. The broken thread extractor -500- takes the thread inside its tube -503- by taking it from the end of the steel strip -811-. This strip -811- is free so that, together with its traction unit, it can be transferred by the arm -822- and motor -823- to its inoperative position. Next the motor -516- which drives the knife -515- starts up and making the knife pass beneath the extractor -500- pulls the mentioned thread very close to the counter-blade -514-, its movement being detained and the motor -513- which has both knives -514- and -515- starting up, until touching the surface of the cloth together with the yarn inserted between the knives. This yarn is kept tense by the action of the suction of the extractor -500-. The motor -404- separates the reed space sensor counter -401- from the surface of the reed -103- and places it in its transfer position. The electronic control device -900- checks that all the devices making up the apparatus (excepting the knives -514- and -515-) are on the transfer position and that the weaving machine is ready to be started up. Once this condition has been checked, the weaving machine starts up and after a few seconds, that is when the auxiliary yarn -113- has been sufficiently bound by the weft, the motor -516- starts up, which drives the knife -515- until the end of the thread which protrudes from the surface of the cloth is cut off and then the mentioned knifes are raised by the arm -512- and the motor -513- up to their transfer position, awaiting the next operation.

The apparatus which is represented in the diagrammatic drawings enclosed having been sufficiently described both with regard to its constitution and with regard to how it operates, it is understood that the mentioned description is only that of the example which has been selected for a clear understanding of the patent. It is evident that the mentioned variant which is described is merely enunciative and does not have a limiting nature for the variants of a complex device such as this are many and may all be equivalent provided that they are included in the object which shall presently be claimed.

I claim:

1. Apparatus for automatically repairing broken warp threads in weaving machines or looms, said apparatus comprising:

a computerized control system having a memory storing predetermined characteristics for drawing-in of a harness and reeding of each one of a plurality of weaving machines as well as characteristics of selvages and a number of threads used, as well as characteristics of warp threads used in said weaving machines; means for receiving information on a row of drop wires which has brought about a stoppage in one of said weaving machines; means receiving data supplied by a detecting device in the form of a numerical position of a fallen drop wire and means for processing said data and sending a transfer order for a moving reed space counting device to go along a reed of said machine and stop at a desired location;

a detecting device controlled by said control system having means for determining a numerical position of said fallen drop wire in a row of drop wires which contains said fallen drop wire, and means for sending information of this position of the fallen drop wire to said computerized control system; and a moving reed space counting device controlled by said control system and having means for moving along the reed of said weaving machine and stopping directly opposite a reed space at the location of a broken end corresponding to the fallen drop wire, responsive to information received as to the position of the fallen drop wire by said control system.

2. Apparatus according to claim 1, wherein the moving reed space counting device is attached to guiding means opposite the reed space corresponding to the broken thread, said guiding means coacting with a fine, flat steel strip suitable for passing through said reed space, said flat steel strip being comprised by a device for drawing in an auxiliary yarn.

3. Apparatus according to claim 1, wherein the device detecting the fallen drop wire comprises a movable unit made up of a movable detecting-counting device having means for entering the row of drop wires containing the fallen drop wire and having means for and detecting said fallen drop wire, stopping such that means for operating said drop wire have access to said drop wire and to adjacent wire.

4. Apparatus according to claim 1, wherein the detecting device comprises opto-electronic sensor means.

5. Apparatus according to claim 1, wherein the detecting device comprises indirect sensor means which indirectly count reed spaces through a gear wheel or wheel covered with a non-slip material, which either by means of meshing with teeth of the reed itself and corresponding count of said space, or by precise measurement of a length travelled from the beginning of the reed, determines precisely the position of a space to be detected.

6. Apparatus according to claim 1, wherein the reed space counting device comprises:

a) movable drop wire sensor means for indicating a position of the fallen drop wire in relation to a row where it is located;

b) high speed counting means combined with said sensor means for determining a number of drop wires up to one corresponding to the broken thread and sending this information to the computerized control system; and c) complementary support and propulsion means for moving the drop wire sensor means from one end of a drop wire line up to a place where the fallen drop wire is and also for returning said sensor means to its initial position.

7. Apparatus according to claim 1, wherein the movable reed space counting device comprises:

a) movable sensor means for indicating a number of reed spaces that said counting device reaches during its movement along the reed;

b) high speed counting means combined with said sensor means for halting movement of said sensor means when a count carried out by said sensor means coincides with a number of reed spaces identified by said control system as corresponding to a drop wire which has fallen due to thread breaking; and c) complementary support and propulsion means controlled by said control system, for displacing said sensor means from one end of a reed up to a place which corresponding to the reed space where a broken thread had been drawn in and also for returning said sensor means to its initial position.

8. Apparatus according to claim 1, further comprising a support frame extending above the weaving machine or loom, fitted with wheels and support rollers for sliding along a guide rail installed in the weaving machine or loom, said frame carrying components constituting said apparatus.

9. Apparatus according to claim 8, further comprising a guide rail adapted to extend between separation rows of a plurality of machines to be repaired, said guide rail having transport and displacement means for supporting the frame which carries components constituting said apparatus.

10. Apparatus according to claim 1, including auxiliary positioning means so that the loom affected by the stoppage is positioned, after the stoppage, so as to allow the repair devices and means to operate.

11. Apparatus for automatically repairing broken warp threads in weaving machines or looms, comprising:

a) a computerized control system having a memory storing predetermined characteristics for harness drawing-in and reeding of each of a plurality of weaving machines as well as characteristics of selvages and a number of threads used, as well as characteristics of warp threads used in said weaving machines; means for receiving information on a row of drop wires which has brought about a stoppage in one of said weaving machines as well as information given by a device detecting a position of a fallen drop wire in relation to a row; means for processing said information and sending a transfer order for a moving reed space counting device to position itself opposite a reed space corresponding to said fallen drop wire; data processing means for sending orders to operation devices constituting repair apparatus, as well as for sending orders and controlling displacement of support means;

b) a moving detecting device adapted to count weaving machine drop wires so as exactly to determine a numerical position of said fallen drop wire in relation to a row where it is located;

c) a moving reed space counting device having means for positioning itself directly opposite the reed space corresponding to a space occupied by a broken warp thread;

d) a device for removing the broken warp thread which is joined to a cloth;

e) a device for removing the broken warp thread which is joined to the warp;

f) a device for selecting and feeding an auxiliary yarn having the same characteristics as the broken warp thread;

g) means for joining said auxiliary yarn to the broken warp thread which is joined to the warp;

h) a drawing-in device for drawing said auxiliary yarn into the corresponding drop wire of said broken warp thread, once said auxiliary yarn has been joined to said broken warp thread;

i) a threading device for picking up said auxiliary yarn which has been drawn in by said drawing-in device and threading it in a heddle of a harness and in a corresponding reed space; and j) means for retaining and tensioning said auxiliary yarn which has been drawn in the heddle of the harness and in the reed and has been positioned on the cloth for its binding into the cloth by means of weft courses, including means for cutting off excess yarn once said joining has been carried out.

12. Apparatus according to claim 11, wherein the device for drawing the auxiliary yarn in the corresponding drop wire includes a moving support carrying a fine, flat steel strip which is pulled by friction cylinders, said flat strip coacting with a strip guide element whose arms and ends guiding the end of the steel strip are inserted between the wire rows.

13. Apparatus according to claim 11, wherein the device removing the ends of the broken threads comprises a movable support means controlled by said control system, and having suction means and roller means for removing a taken-in thread and detecting means for determining completion of a removal operation.

14. Apparatus according to claim 11, wherein the device for selecting and feeding an auxiliary yarn of the same characteristics as the broken warp thread comprises:

a) a creel with at least one coil for each one of the types of thread making up the warp of the weaving machine;

b) means for retaining and placing the end of the thread of each one of these coils in a position such that each said end can be picked up by a movable nipper which selects a desired thread;

c) means for threading a selected thread on a thread guide;

d) means for transferring said thread to knotting means where said auxiliary yarn is joined to the end of the broken warp thread; and e) means for retaining and then cutting off the end of said auxiliary yarn coming from the corresponding coil when a sufficient length of yarn has been unwound so that the mentioned end, once drawn in the drop wire and threaded through the heddle and the reed space, is joined to the cloth once the weaving machine has started up again.

15. Apparatus according to claim 2, wherein the device for drawing-in the auxiliary yarn through the drop wire comprises a unit made up of:

a) means for separating the drop wire corresponding to the broken thread from adjacent threads and drop wires;

b) means for lifting up, the drop wire as well as displacing it angularly so that drawing-in thereof can be effected;

c) a fine steel strip drawn by motor rollers;

d) means for guiding said fine steel strip provided on one end with an oblique slot which picks up the thread and places it into a drop wire opening;

e) guide means so arranged that said steel strip catches the auxiliary yarn which has been selected once it has been joined to the warp thread; and f) means for returning the fine steel strip to an initial position so that the yarn caught by the strip is drawn into the drop wire.

16. Apparatus according to claim 11, wherein the device drawing-in the auxiliary yarn through the heddle of the harness and through the reed space includes a unit comprising:

a) movable guiding means for entering rearwardly between the heddles of the harnesses until occupying a position close to the reed, and separating the heddles and their threads so that the heddle to be drawn-in enters therebetween; and b) a fine steel strip drawn by motor rollers, which enters the corresponding reed space detected by the reed space counting device and then, driven by the said movable guiding means where the heddle has entered, crosses said heddle, comes out the other end of the guiding means where it picks up the selected thread which has been threaded by the drop wire and on returning in the opposite direction, draws said thread through the heddle and the reed space.

17. Apparatus according to claim 11, wherein the means for retaining and tensioning the broken thread coming from the cloth as well as the end of the auxiliary yarn which has already been drawn in through the reed, comprises movable support means carrying a shear which is placed adjacent the surface of the cloth in a position in which the removing device coacts in sucking the end of the broken thread joined to the cloth as well as the threaded auxiliary yarn, excess thread being thereafter cut off by means of said shear.

18. Apparatus according to claim 11, wherein the drop wire threading device also includes two independent drop wire actuating parts arranged face to face, which are adapted to draw apart and draw together horizontally and are also fitted on a vertically displaceable support, said two parts being adapted to catch a fallen drop wire between their arms, and through bevels established at their lower ends to separate the warp threads from the fallen drop wire, both arms being long enough to descend to a position below the plane of the warp.

19. Apparatus according to claim 11, wherein the drop wire threading device further comprises a movable guiding part for a fine steel strip, which moves so that it extends from an outlet of strip-guide elements extending from the drop wires to the rear part of the loom where the auxiliary yarn and the broken warp thread have been knotted together, with each movable guide part having a groove on its side closest to the warp for guiding the fine steel strip.

20. Apparatus according to claim 11, wherein the drop wire threading device further comprises a pair of rocking parts for separating drop wires, said rocking parts having bevelled ends which enter between two drop wires on adjacent sides of the fallen drop wire, and separate said wires by turning sufficiently so that in the space produced, the means for separating the drop wires adjacent the fallen drop wire can enter therein.

* * * * *

UNITED STATES PATENT AND TRADEMARK OFFICE

CERTIFICATE OF CORRECTION

PATENT NO. : 5,046,535

DATED : September 10, 1991

INVENTOR(S) : Roberto ESCURSELL PRAT

It is certified that error appears in the above—identified patent and that said Letters Patent is hereby corrected as shown below:

On the title page item [19]

change "Prat" to --Escursell Prat--.

On the title page item [75] change the name of the inventor to

--Roberto Escursell Prat--.

Signed and Sealed this

Twenty-second Day of December, 1992

*Attest:*

DOUGLAS B. COMER

*Attesting Officer*

*Acting Commissioner of Patents and Trademarks*